US006602087B1

(12) United States Patent
Carle

(10) Patent No.: US 6,602,087 B1
(45) Date of Patent: Aug. 5, 2003

(54) RELEASABLE EXTENSION CORD CONNECTOR APPARATUS

(76) Inventor: Denis A. Carle, 10206 Rubury Pl., Tampa, FL (US) 33626

( * ) Notice: Subject to any disclaimer, the term of this patent is extended or adjusted under 35 U.S.C. 154(b) by 0 days.

(21) Appl. No.: 10/207,159

(22) Filed: Jul. 30, 2002

Related U.S. Application Data

(60) Provisional application No. 60/308,095, filed on Jul. 30, 2001.

(51) Int. Cl.[7] ..... H01R 13/62
(52) U.S. Cl. ..... 439/369; 439/367
(58) Field of Search ..... 439/367, 368, 439/369, 372, 491, 315, 467, 596

(56) References Cited

U.S. PATENT DOCUMENTS 3,030,601 A * 4/1962 Krebs ..... 439/369
4,169,643 A * 10/1979 Gallagher ..... 439/369
5,135,409 A * 8/1992 Thompson ..... 439/367
5,813,879 A * 9/1998 Russo ..... 439/367
6,250,946 B1 * 6/2001 Tardy ..... 439/367
6,454,576 B1 * 9/2002 Hedrick et al. ..... 439/105

* cited by examiner

*Primary Examiner*—Tho D. Ta
(74) *Attorney, Agent, or Firm*—Krieg DeVault Lundy, LLP

(57) ABSTRACT

A male coupling connector has a first half male portion and a second half male portion, which are hinged together between open and closed positions. A female coupling connector has a first half female portion and a second half female portion, which are hinged together between open and closed positions. The female connector is sized to be slidably positioned and securely interconnected about the male connector in a closed position at assembly, to enclose an in-line electrical plug and socket therein. Ridges and grooves extend in parallel, side by side relation about the outer circumference of the first and second half male portions. Ridges and grooves extend in side by side relation about the inner circumference of the female connector. The ridges and grooves on the male coupling connector interlock with the ridges and grooves on the female connector portion. The male coupling connector is pivotally closed and releasably secured about a portion of the in-line electrical plug and socket. The female coupling connector is then adjustably positioned and releasably secured about the male coupling connector to adjust the length of the electrical cord connector to suit the length of the socket and plug, to prevent disconnection during use.

16 Claims, 6 Drawing Sheets

TO OPEN
POSITION LOGO IN PALM OF HAND ALIGN ARROWS SQUEEZE WITH FINGERS JUST ABOVE ARROWS.

ADJUSTABLE RINGS
LOCK CORD CONNECTIONS IN PLACE FOR A SNUG FIT.

TO CLOSE
SNAP SHUT AND PRESS DOWN ON TOP RIDGE ABOVE ARROWS AS SHOWN.-

RELEASABLE EXTENSION CORD CONNECTOR APPARATUS

CROSS REFERENCE TO RELATED APPLICATIONS

This patent application claims priority of Provisional Patent Application, Serial No. 60/308,095 filed Jul. 30, 2001, and this provisional patent application is incorporated by reference herein.

SEQUENCE LISTING

Not Applicable

STATEMENT REGARDING FEDERALLY SPONSORED RESEARCH AND DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a releasable extension cord connector, to secure joined in-line electrical socket and plug connectors together to prevent inadvertent disconnection, and to protect the male and female terminals from damage during use.

2. Background of the Invention

There are numerous electrical plug enclosures known in the prior art. Example embodiments of such electrical plug enclosures include:

U.S. Pat. No. 5,755,588 issuing to Bobby Sweatman on May 26, 1998, which discloses a retention enclosure for in-line electrical plugs. The enclosure is fixed in length, and thus not readily adaptable to the many sizes and shapes of electrical plugs found in the marketplace.

U.S. Pat. No. 4,940,424 issuing to Larry Odbert on Jul. 10, 1990, discloses an electrical plug assessory having two cylindrical members, which gengage one another with protuberances which slide and latch together. This provides limited adjustment in length.

U.S. Pat. No. 3,048,810 issuing to C. Steen on Aug. 7, 1962 discloses a one piece coupling for electrical plugs. The housing has a slot for receiving the joined plugs, and a cord is used to secure the opening. Following insertion of the electrical plugs in the coupling.

U.S. Pat. No. 5,762,515 issuing to Peter Mele, on Jun. 9, 1998 discloses a security coupling for electrical plugs, wherein an elastically expandible tube is passed over the electrical plugs, and held in place with a rollable ring on each end.

Numerous other extension cord connector patents are also found in the prior art, such as U.S. Pat. Nos. 6,080,004; 6,056,580; 5,913,693; 5,913,692; 5,772,462; 5,505,634; 5,443,397; 5,393,243; 5,306,176; 5259,782; 5,217,387; 5129,839; 4,784,612; and 4,643,505.

No prior art patents were found having a hinged, male coupling connector and a hinged female coupling connector. The hinged female coupling connector is adjustably secured about the hinged male coupling connector, to adjust the length of the extension cord connector to suit the length of the in-line plug and socket. This combination provides a compact extension cord connector, which is adjustable in length to suit a large variety of plug sizes and shapes. The aerodynamic shape of the opposing ends of the extension cord connector minimizes the danger of tripping or snagging the extension cord connector during use, while protecting the in-line socket and plug from the environment. The adjustable length feature ensures that smaller plugs will not pull apart from the socket during use, because the extension cord connector is selectively adjusted in length to closely receive the male and female in-line plugs therein.

BRIEF SUMMARY OF THE INVENTION

A male coupling connector has a first half male portion and a second half male portion, which are hinged together between open and closed positions. A female coupling connector has a first half female portion and a second half female portion, which are hinged together between open and closed positions. The female connector is sized to be slidably positioned and securely interconnected about the male connector in a closed position at assembly, to enclose an in-line electrical plug and socket therein. Ridges and grooves extend in parallel, side by side relation about the outer circumference of the first and second half male portions. Ridges and grooves extend in side by side relation about the inner circumference of the female connector. The ridges and grooves on the male coupling connector interlock with the ridges and grooves on the female connector portion. The male coupling connector is pivotally closed and releasably secured about a portion of the in-line electrical plug and socket. The female coupling connector is then adjustably positioned and releasably secured about the male coupling connector to adjust the length of the electrical cord connector to suit the length of the socket and plug.

Once the female coupling connector is adjustably positioned and releasably secured about the male coupling connector, they cannot become dislodged by normal use, until the second hinged coupling is unsecured from the first hinged coupling. The first and second electrical plug and socket are protected from accidental damage by a double circumferential wall of ridges and grooves, which ensures that the electrical plug and socket will not be damaged, even when the extension cord connector is inadvertently stepped on during use.

Other objects and advantages of the present invention will be more readily apparent from the following detailed description when read in conjunction with the accompanying drawings.

DETAILED DESCRIPTION OF THE INVENTION

Figure 1:
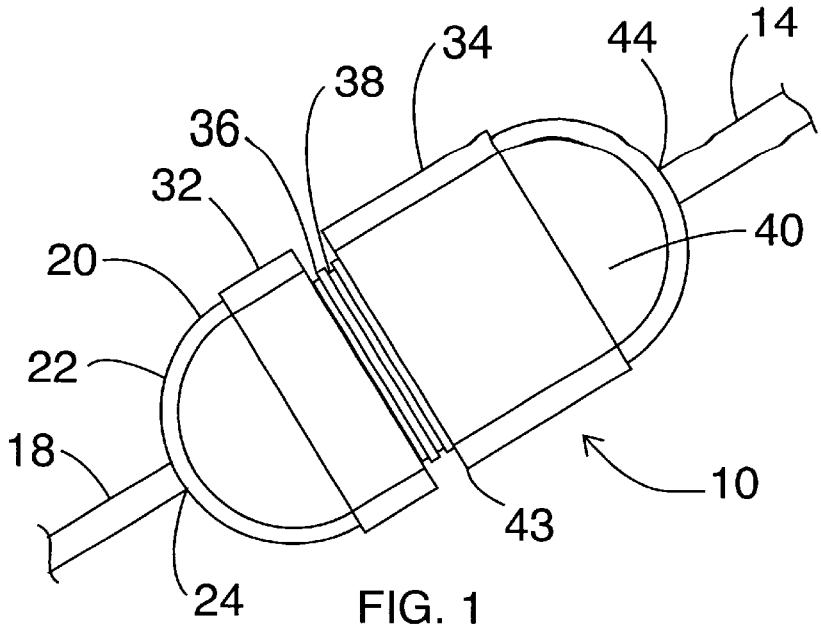
FIG. 1 is a perspective view of the assembled extension cord connector apparatus, showing the male and female connectors joined together in a closed position about an in-line electrical plug and socket.

FIG. 1 is a perspective view of the assembled extension cord connector apparatus 10, showing the electrical socket 12 and electrical plug 16 joined together in a closed position about an inline electrical socket 12 and plug 16.

Figure 2:
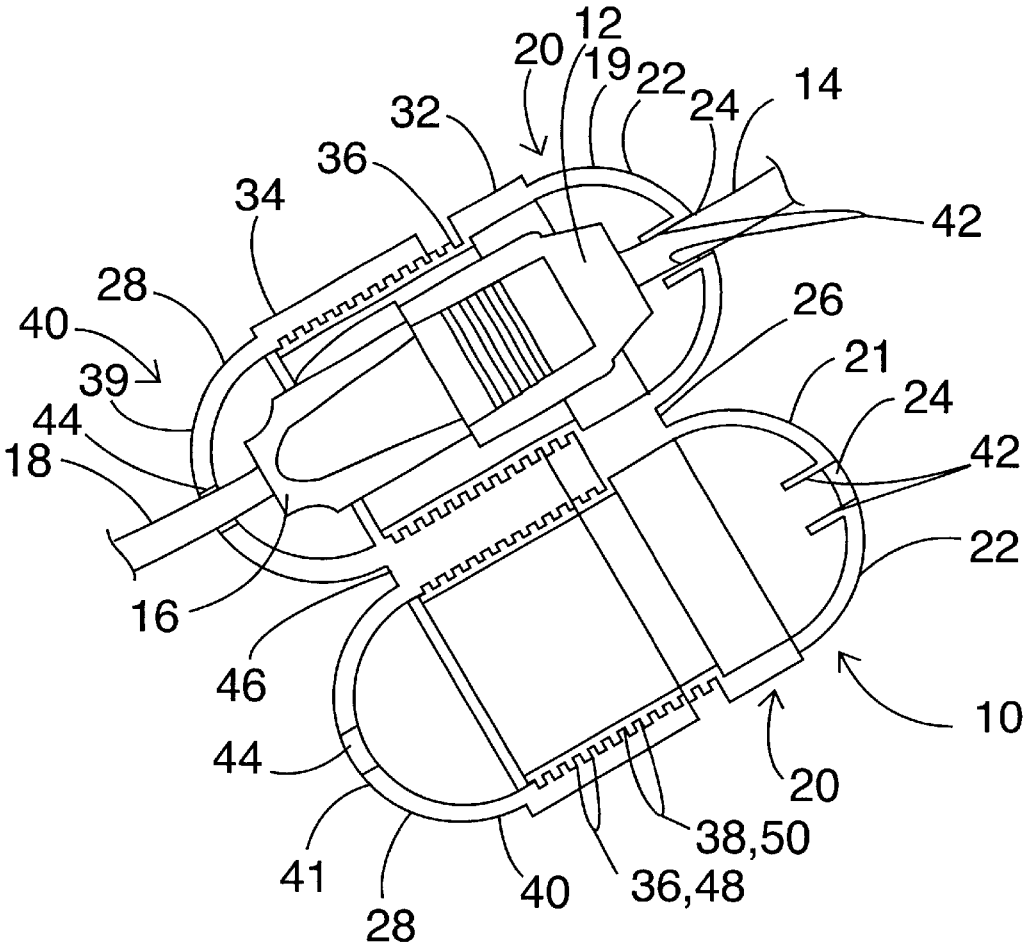
FIG. 2 is a top view of the assembled male and female connectors joined together and hinged into an open position about the in-line electrical plug and socket.

FIG. 2 shows the male coupling connector 20 and the female coupling connector 40 joined together in an open position. The male coupling connector 20 is shown hinged 26 into an open position. Likewise, the female coupling connector 40 is also shown hinged 46 into an open position. The electrical plug and socket 12, 16 are shown inserted within the male and female coupling connectors 20, 40. Note that the male coupling connector 20 is adjustably positioned in relation to the female coupling connector 40 to adjust the length of the electrical cord connector apparatus 10 to suit the combined length of the electrical socket 12 and electrical plug 16. This prevents the in-line electrical socket 12 and plug 16 from pulling out or otherwise becoming disengaged, when the electrical plug cord 18 and/or the electrical socket cord 14 are pulled or entangled, during use.

Figure 3A:
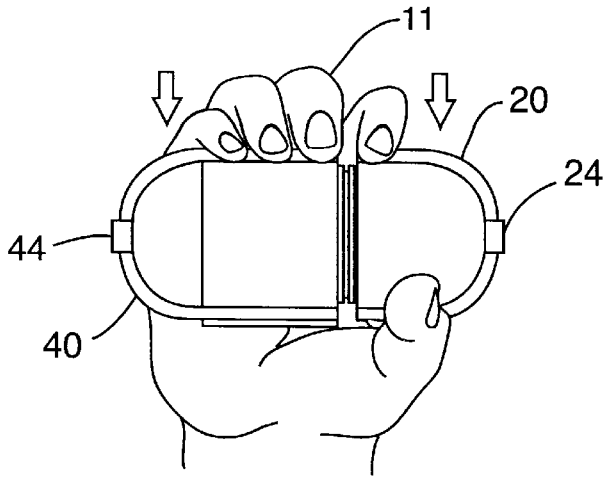
FIG. 3A is a view of the extension cord connector with a user's hand positioned to open the extension cord connector.
Figure 3B:
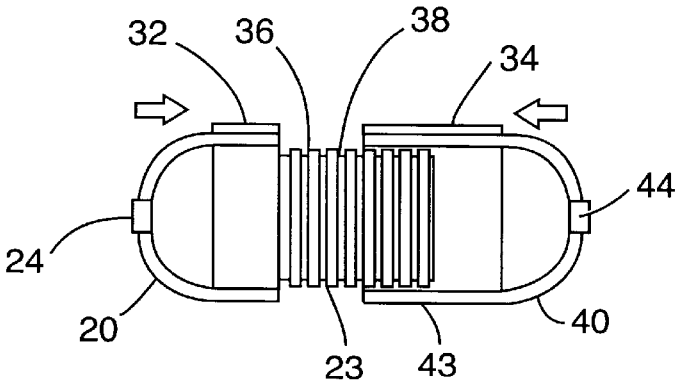
FIG. 3B is a view of the extension cord connector showing the adjustable rings and grooves selectively extended or retracted to suit the length of the in-line electrical plug and socket.
Figure 3C:
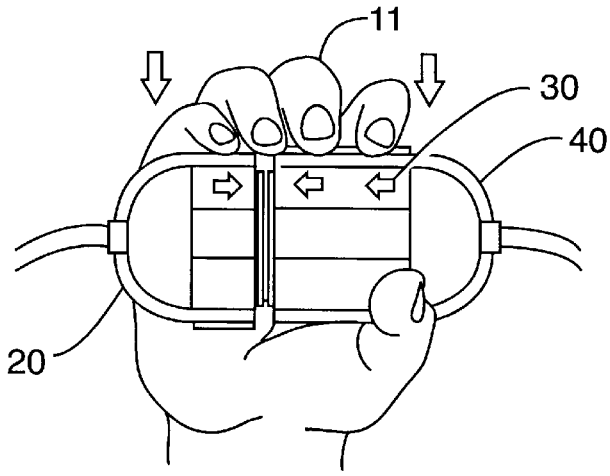
FIG. 3C is a view of the extension cord connector with a user's hand positioned to close the extension cord connector apparatus at a desired length to suit the length of the in-line electrical plug and socket.

The offset alignment of the male hinged portion 26 and the female hinged portion 46 enables the joined male and female connectors 20, 40 to be easily hinged between open and closed positions, even when the radial ridges and grooves 36, 38 and 48, 50 of the male and female connectors 20, 40 are jointed together at a selected length, as shown in FIG. 3A through FIG. 3C.

As shown in FIG. 2, the external radial ridges 36 and external radial grooves 38 of the male connector 20 are adjustably positioned and closely received in radial alignment with the internal radial ridges 48 and internal radial grooves 50 on the female coupling connector 40. In the closed position shown in FIG. 1, the female connector 40 housing is releasably secured about the male connector 20 housing with a releasable securement means 32, 34.

Referring now to FIG. 3A, the male and female coupling connectors 20, 40 are grasped by a user, and squeezed with the user's fingers 11 just above the indicia 30, such as the arrow shown in FIG. 3A, to release the male coupling connector 20 from the female coupling connector 40. Once released, the male and female connectors 20, 40 may be adjustably positioned to suit the length of the electrical plug and socket 12, 16, as shown in FIG. 3B. This ensures that the in-line connection of the electrical plug and socket 12, 16 will not become unconnected during use, even when the electrical cords 14, 18 become snagged or pulled during use.

Once the electrical cord connector apparatus 10 has been properly positioned, the user presses down on the top ridge located above the indicia 30, to releasably secure the electrical cord connector apparatus 10 about the electrical plug and socket 12, 16, as shown in FIG. 3C. Thus, the user may easily install and releasably secure the electrical cord connector apparatus 10 about a variety of sizes of in-line electrical socket and plug 12, 16, without the need for tools, or other time consuming procedures.

Referring now to FIG. 4A through FIG. 4D, the male coupling connector 20 is shown in an open position, with a first half male portion 19 side by side with a second half male portion 21. The first and second half male portions 19, 21 are joined together with a flexible hinge portion 26 to form the male connector housing. Any known flexible hinge portion 26 may be used without departing from the scope of this invention or from the following claims.

Figure 4A:
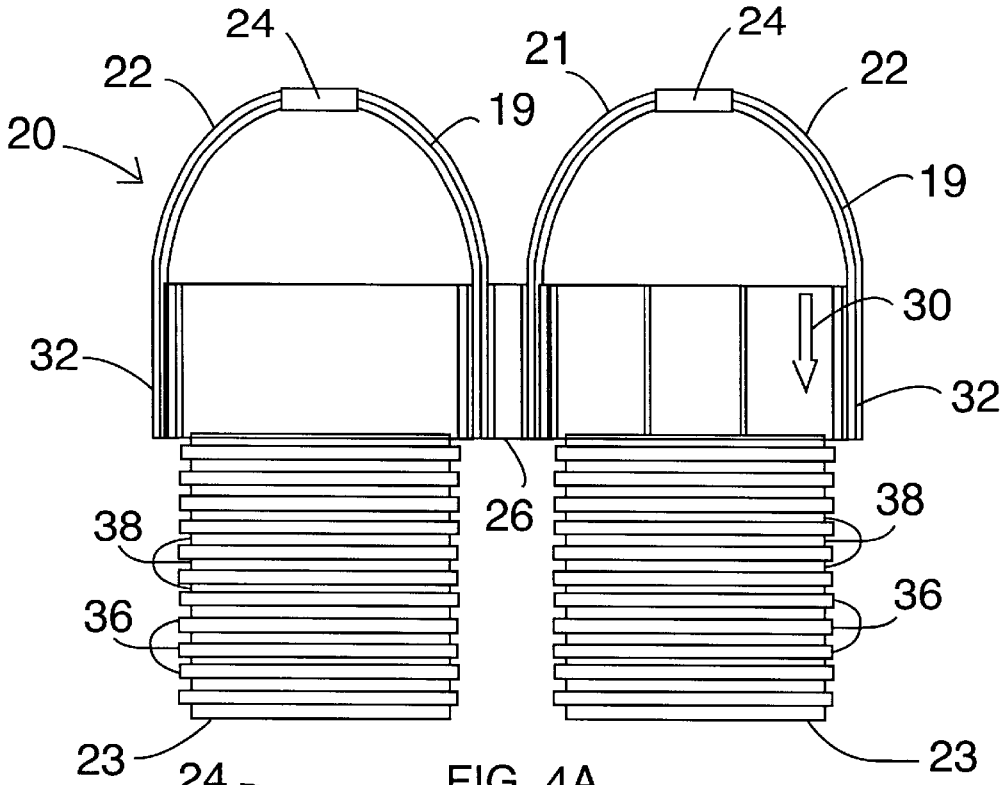
FIG. 4A is a top elevational view of the male coupling connector shown in an open position.

FIG. 4A is a top elevation view of the male coupling connector 20 showing the external portion of the first and second half male portions 19, 21 positioned side-by-side in an open position, with a plurality of radial ridges 36 and grooves 38 located on the male grooved end 23.

Figure 4B:
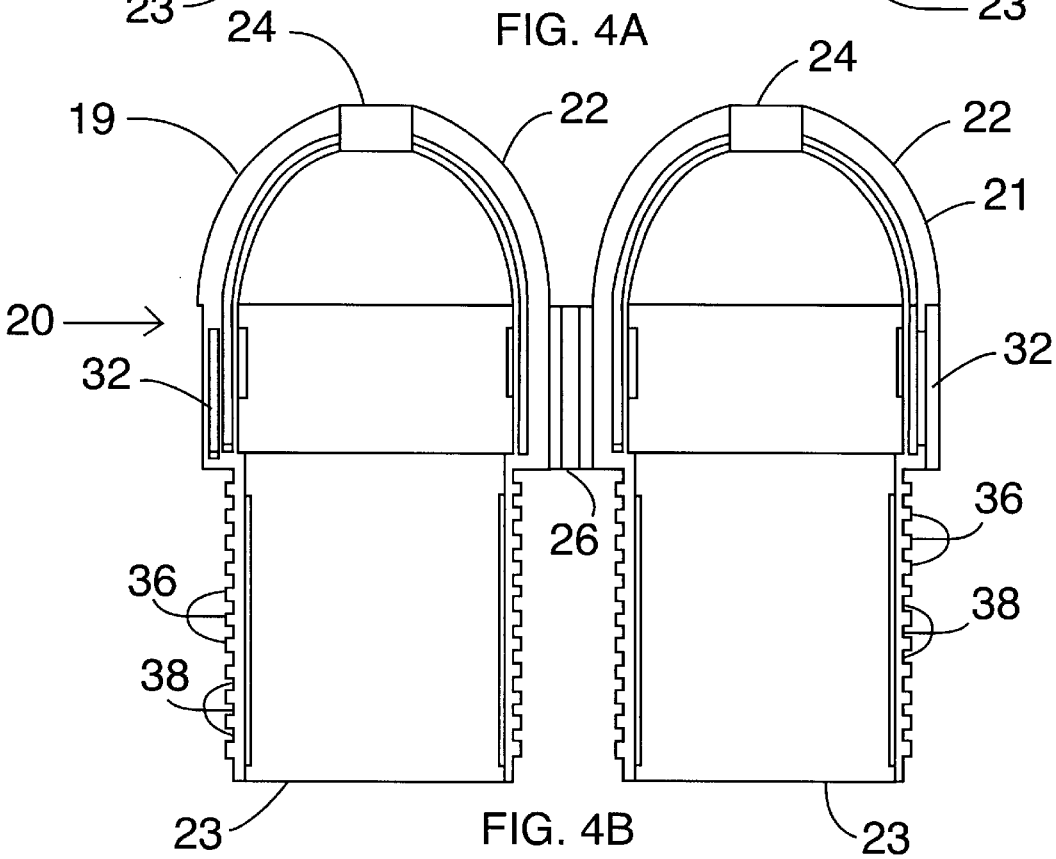
FIG. 4B is a bottom elevational view of the male coupling connector shown in an open position.
Figure 4C:
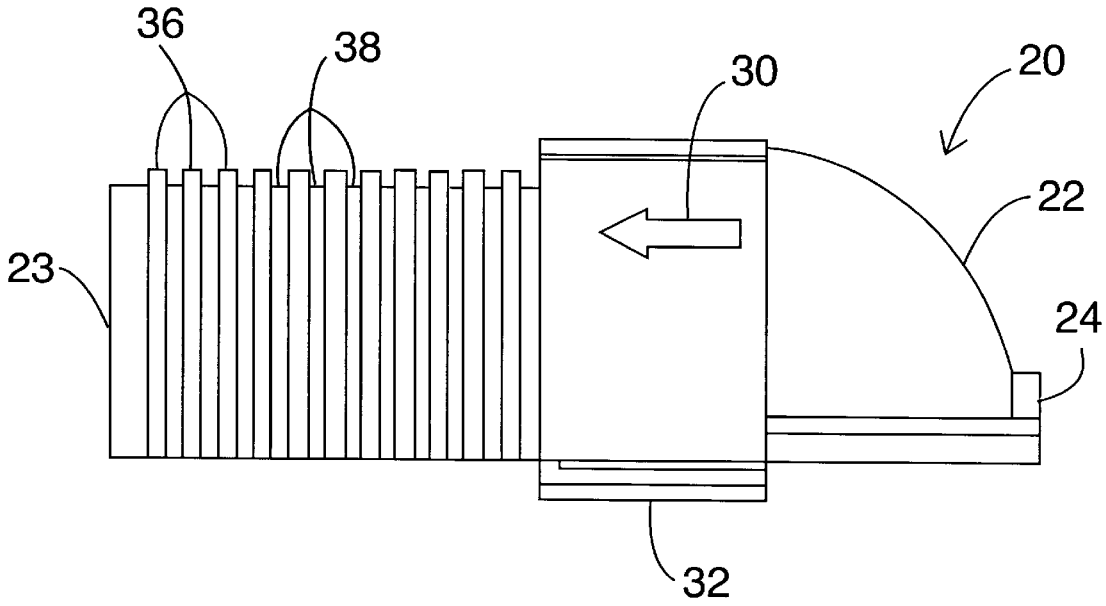
FIG. 4C is a side elevational view of the male coupling connector.
Figure 4D:
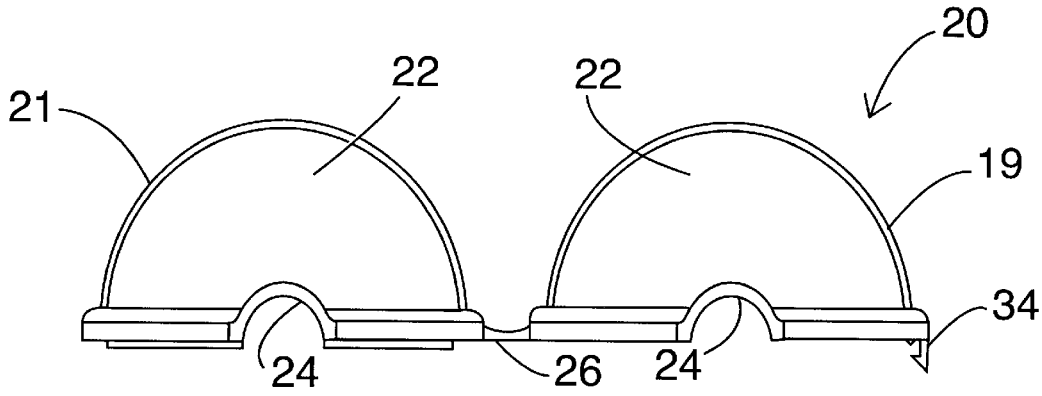
FIG. 4D is an end elevational view of the male coupling connector, shown in an open position.

FIG. 4B is a bottom elevational view of the male coupling connector 20, showing the internal portion of the first and second half male portions 19, 21. FIG. 4C is a side elevational view of the male coupling connector 20, and FIG. 4D is an end elevational view of the male coupling connector 20, with first and second half male portions 19, 21 shown side-by-side.

The male coupling connector 20 preferably has a rounded or bullet nosed end 22. A male end aperture 24 extends through the bullet nosed end 22 of at least one of the first and second half male portions 19, 21 of the male coupling connector 20. The male end aperture 24 is sized to receive an electrical cord 18 therethrough, when the male coupling connector 20 is positioned in the closed position shown in FIG. 1. The male end aperture 24 preferably has an aperture extension 42. The aperture extension 42 limits travel of the electrical socket within the male coupling connector housing 20.

Preferably, one half of the male end aperture 24 is located in the first half male portion 19, and the other half of the male end aperture 24 is located in the second half male portion 21. This allows the electrical plug 16 or socket 12 to be placed within one of the first and second half male portions 19, 21, with the electrical cord 14 or 18 positioned to extend through a portion of the male end aperture 24. Once the first and second half male portions 19, 21 are rotated into a closed position about male hinged portion 26, the electrical cord 14 or 18 is closely received and retained within the male end aperture portion 24.

A plurality of external, radial ridges and grooves 36, 38 extend about the male grooved end 23 of the male coupling connector 20. The plurality of external radial ridges and grooves 36, 38 increase the strength of the male coupling connector 20, while providing an adjustable connection with the internal ridges and grooves 48, 50 located on the female coupling connector 40.

Preferably, the first half male portion 19, the second half male portion 21 and the flexible male hinge portion 26 are preferably injection molded as a single piece of plastic material, to form the male coupling connector housing 20.

Referring now to FIG. 5A through FIG. 5D, the female coupling connector 40 is shown in an open position, with a first half female portion 39 side-by-side with a second half female portion 41. The first and second half female portions 39, 41 are joined together with a flexible hinge 46, to form the female coupling connector housing 40.

Figure 5A:
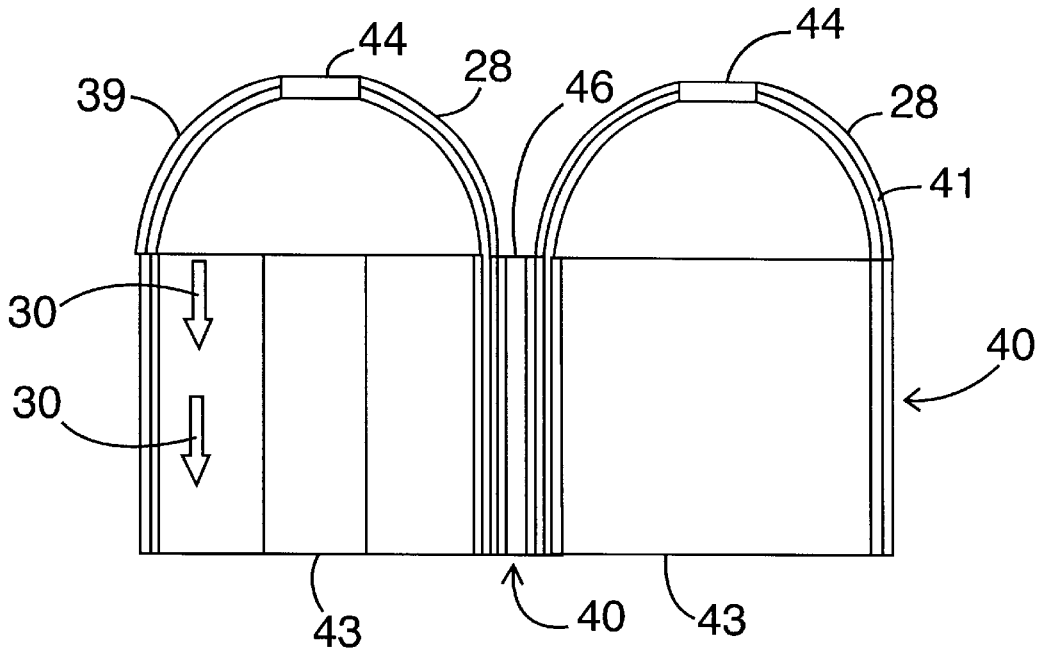
FIG. 5A is a top elevational view of the female coupling connector shown in an open position.
Figure 5B:
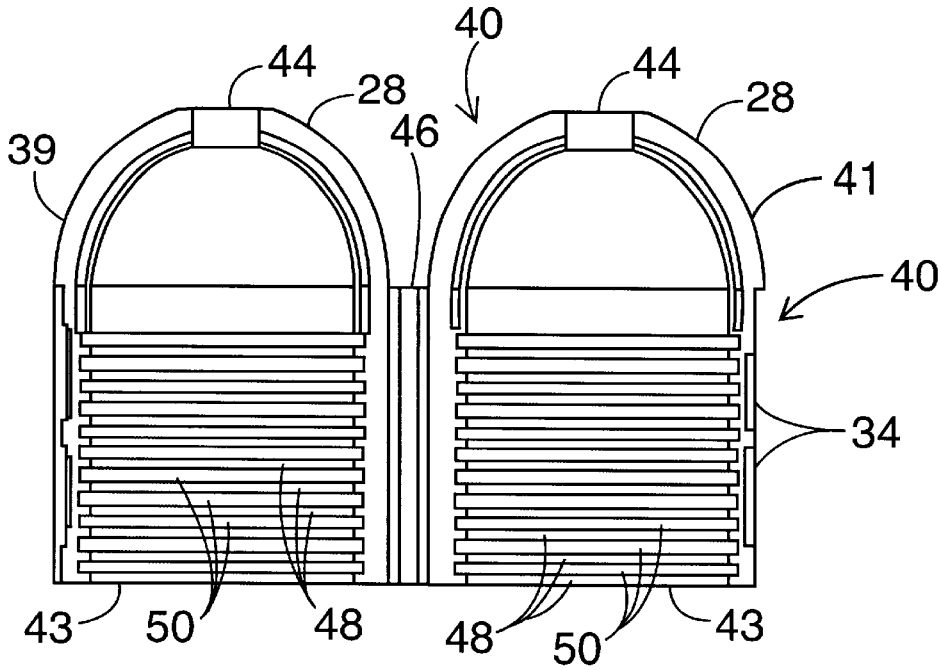
FIG. 5B is a bottom elevational view of the female coupling connector shown in an open position.

FIG. 5A is a top elevation view of the female coupling connector 40, showing the external portion of the first and second half female portions 39, 41. FIG. 5B is a bottom elevational view of the female coupling connector 40, showing the internal portion of the first and second half female portions 39, 41. The female coupling connector 40 preferably has a rounded or bullet nosed end 28. A plurality of internal radial ridges 48 and grooves 50 are located on the grooved end 43.

Figure 5C:
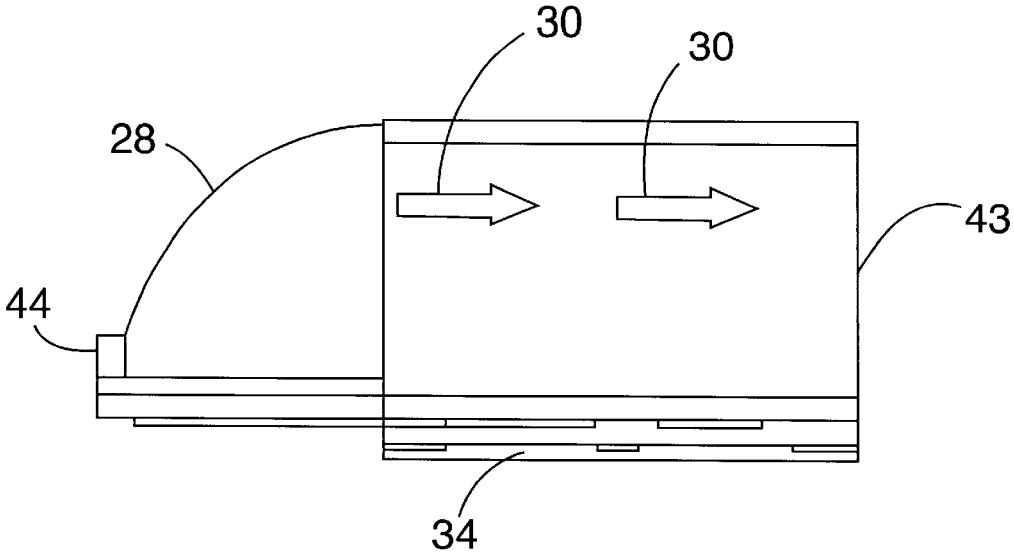
FIG. 5C is a side elevational view of the female coupling connector.
Figure 5D:
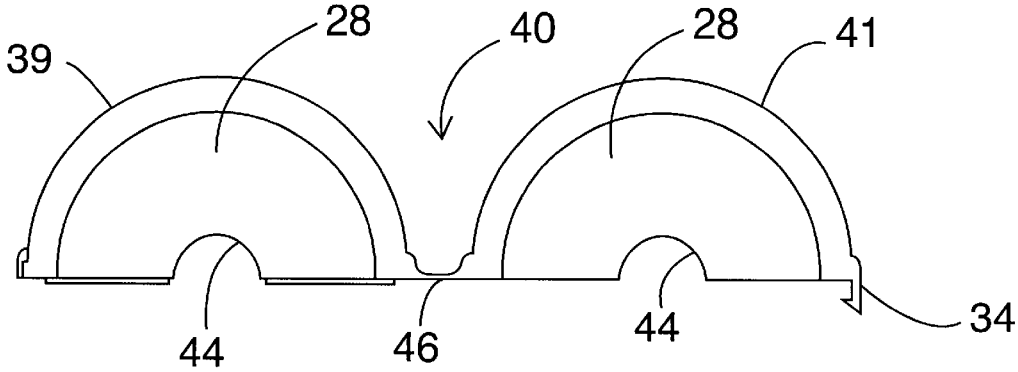
FIG. 5D is an end elevational view of the female coupling connector, shown in an open position.

FIG. 5C is a side elevational view of the female coupling connector 40, and FIG. 5D is an end elevational view of the female coupling connector 40, with the first and second half female portions 39, 41 shown side-by-side.

The female coupling connector 40 also has a rounded or bullet nosed end 42. A female end aperture 44 extends through the end 28 of the female coupling connector 40. The female end aperture 44 is sized to receive an electrical cord 18 therethrough.

A male releasable securement means 32 is provided to releasably secure the first half male portion 19 to the second half male portion 21. Any known releasable securement means may be used, without departing from the scope of this disclosure, or from the following claims. Likewise, a female releasable securement means 34 is provided to releasably secure the first half female portion 39 to the second half female portion 41.

The first half female portion 39, the second half female portion 41 and the flexible female hinge portion 46 are preferably injection molded as a single piece of plastic material to form the female coupling connector housing 40.

When the female coupling connector housing 40 is enclosed about the male coupling connector housing 20 as shown in FIG. 1, with the electrical socket and plug 12, 16 releasably secured therein, the electrical socket and plug 12, 16 will not become disengaged when the electrical cord 14, 18 is pulled around corners or objects during use. The electrical socket and plug 12, 16 will be protected, even when the electrical cord connector apparatus 10 is stepped on. The bullet nosed shape of the male and female coupling connector housings 20, 40 enable the electrical cord connector apparatus 10 to resist entanglement when pulled around corners and past objects, such as ladders, or building materials and equipment.

Various changes and adaptations may be made to the preferred embodiment of this invention by one of average skill in this art, and such changes and adaptations are intended to be included within the scope of this disclosure, and the following claims.

What is claimed is:

1. A releasable extension cord connector apparatus, which comprising:

a) a male coupling connector housing with a first half male portion and a second half male portion, the first half male portion and the second half male portion being hinged together between open and closed positions and being sized to receive a portion of a connected inline male and female electrical plug and socket therein, the first half male portion and the second half male portion each having a first end and a second end;

b) a plurality of ridges and grooves being positioned to extend in parallel, side by side alignment about the first end of the first and second half male portions;

c) a male end aperture being positioned to extend through the second end of at least one of the first half male portion and the second half male portion, the male end aperture being sized to receive an electrical cord therethrough;

d) a female coupling connector housing with a first half female portion and a second half female portion, the first half female portion and the second half female portion being hinged together between open and closed positions and being sized to receive a portion of the connected inline male and female electrical plug and socket therein, the first half female portion and the second half female portion each having a first end and a second end;

e) a female end aperture positioned extends through the second end of at least one of the first half female portion and the second half female portion, the female end aperture being sized to receive an electrical cord therethrough;

f) a plurality of ridges and grooves being positioned to extend in parallel, side by side alignment about the first end of the first and second half female portions, the plurality of ridges and grooves being located on the first end of the first and second half female portions sized to encircle and engage the plurality of ridges and grooves located upon the first end of the first and second male portions, enabling the adjustable positioning of the length of the releasable extension cord connector apparatus to suit the length of the electrical plug and socket inserted within the releasable extension cord connector apparatus to avoid disconnection between the electrical plug and socket when the electrical cord is pulled;

g) a first releasable securement means being secured to the first end of the first half male portion, and a second releasable securement means being secured to the first end of the second half male portion, the first and second releasable securement means being positioned to engage and releasably secure the first and second half male portions together when the first and second half male portions are pivoted about the male hinge into a closed position;

h) a third releasable securement means being secured to the first end of the first half female portion, and a fourth releasable securement means being positioned to engage and releasably secure the first and second half female portions together when the first and second half female portions are pivoted about the female hinge into a closed position about the first end of the closed male portion.

2. The releasable extension cord connector apparatus of claim 1, wherein the first half male portion and the second half male portion are hinged together with a flexible hinge portion, and the first half female portion and the second half female portion are hinged together with a flexible hinge portion.

3. The releasable extension cord connector apparatus of claim 1, wherein the male end aperture includes an aperture extension to limit ravel of the electrical plug and socket within the male coupling connector housing.

4. The releasable extension cord connector apparatus of claim 1, wherein the female end aperture includes an aperture extension to limit ravel of the electrical plug and socket within the female coupling connector housing.

5. The releasable extension cord connector apparatus of claim 1, wherein the first half male portion, the second half male portion and the male hinge portion are preferably injection molded as a single piece of plastic material.

6. The releasable extension cord connector apparatus of claim 1, wherein the first half female portion, the second half female portion and the female hinge portion are preferably injection molded as a single piece of plastic material.

7. The releasable extension cord connector apparatus of claim 1, wherein the male end aperture located through the second end of at least one of the first and second male portions, comprises a first open slot in the first male portion in alignment with an open slot in the second male portion, the first open slot and the second open slot being aligned to form an aperture through the second end of the first and second male portions when the first and second male portions are pivoted about the flexible hinge into a closed position.

8. The releasable extension cord connector apparatus of claim 1, wherein the first and second male coupling connectors form a rounded end to resist entanglement when the closed first and second male coupling connectors are pulled around corners and past objects, during use.

9. The releasable extension cord connector apparatus of claim 8, wherein the rounded end of the closed first and second male coupling connectors are shaped with a bullet nosed end.

10. The releasable extension cord connector apparatus of claim 1, wherein the first and second female coupling connectors form a rounded end to resist entanglement when the closed first and second female coupling connectors are pulled around corners and past objects, during use.

11. The releasable extension cord connector apparatus of claim 10, wherein the rounded end of the closed first and second female coupling connectors are shaped with a bullet nosed end.

12. A releasable extension cord connector apparatus, further comprising:

a) a male coupling connector housing with a first half male portion and a second half male portion, the first half male portion and the second half male portion being flexibly hinged and molded as a single housing, and being movable between open and closed positions and being sized to receive a portion of a connected inline male and female electrical plug and socket therein, the first and second male coupling connectors portions forming a rounded end to resist entanglement when the closed first and second male coupling connectors are pulled around corners and past objects, the first half male portion and the second half male portion each having a first end and a second end;

b) a plurality of ridges and grooves being positioned to extend in parallel, side by side alignment about the first end of the first and second half male portions;

c) a male end aperture being positioned to extend through the second end of at least one of the first half male portion and the second half male portion, the male end apertures being sized to receive an electrical cord therethrough;

d) a female coupling connector housing with a first half female portion and a second half female portion, the first half female portion and the second half female portion being flexibly hinged and molded as a single housing, and movable between open and closed positions and sized to receive a portion of a connected inline male and female electrical plug and socket therein, the first and second female coupling connectors form a rounded end to resist entanglement when the closed first and second female coupling connectors are pulled around corners and past objects, the first half female portion and the second half female portion each having a first end and a second end;

e) a female end aperture being positioned to extends through the second end of at least one of the first half female portion and the second half female portion, the female end aperture being sized to receive an electrical cord therethrough;

f) a plurality of ridges and grooves being positioned to extend in parallel, side by side alignment about the first end of the first and second half female portions, the plurality of ridges and grooves being located on the first end of the first and second half female portions and sized to encircle and engage the plurality of ridges and grooves located upon the first end of the first and second male portions, enabling the adjustable positioning of the length of the releasable extension cord connector apparatus to suit the length of the electrical plug and socket inserted within the releasable extension cord connector apparatus to avoid disconnection between the electrical plug and socket when the electrical cord is pulled;

g) a first releasable securement means being secured to the first end of the first half male portion, and a second releasable securement means being secured to the first end of the second half male portion, the first and second releasable securement means being positioned to engage and releasably secure the first and second half male portions together when the first and second half male portions are pivoted about the male hinge into a closed position;

h) a third releasable securement means being secured to the first end of the first half female portion, and a fourth releasable securement means being secured to the first end of the second half female portion, the third and fourth releasable securement means being positioned to engage and releasably secure the first and second half female portion together when the first and second half female portions are pivoted about the female hinge into a closed position about the first end of the closed male portion.

13. The releasable extension cord connector apparatus of claim 12, wherein the female and male end apertures include an aperture extension to limit ravel of the electrical plug and socket within the female coupling connector housing.

14. The releasable extension cord connector apparatus of claim 12, wherein the rounded end of the closed first and second male coupling connectors are shaped with a bullet nosed end, and the rounded end of the closed first and second female coupling connectors are also shaped with an opposing bullet nosed end.

15. A releasable extension cord connector apparatus comprising:

a) a male coupling connector housing with a first half male portion and a second half male portion, the first half male portion and the second half male portion being flexibly hinged and molded as a single housing, and being movable between open and closed positions and being sized to receive a portion of a connected inline male and female electrical plug and socket therein, the first half male portion and the second half male portion each having a first end and a second end;

b) a plurality of ridges and grooves being positioned to extend in parallel, side by side alignment about the first end of the first and second half male portions;

c) a male end aperture being positioned to extend through the second end of at least one of the first half male portion and the second half male portion, the male end aperture being sized to receive an electrical cord therethrough;

d) a female coupling connector housing with a first half female portion and a second half female portion, the first half female portion and the second half female portion being flexibly hinged and molded as a single housing, and being movable between open and closed positions and being sized to receive a portion of a connected inline male and female electrical plug and socket therein, the first half female portion and the second half female portion each having a first end and a second end;

e) a female end aperture being positioned to extends through the second end of at least one of the first half female portion and the second half female portion, the female end aperture being sized to receive an electrical cord therethrough;

f) a plurality of ridges and grooves being positioned to extend in parallel, side by side alignment about the first end of the first and second half female portions, the plurality of ridges and grooves being located on the first end of the first and second half female portions and sized to encircle and engage the plurality of ridges and grooves located upon the first end of the first and second male portions, enabling the adjustable positioning of the length of the releasable extension cord connector apparatus to suit the length of the electrical plug and socket inserted within the releasable extension cord connector apparatus to avoid disconnection between the electrical plug and socket when the electrical cord is pulled;

g) a first releasable securement means being secured to the first end of the first half male portion, and a second releasable securement means being secured to the first end of the second half male portion, the first and second releasable securement means being positioned to engage and releasably secure the first and second half male portions when the first and second half male portions are pivoted about the male hinge into a closed position;

h) a third releasable securement means secured to the first end of the first half female portion, and a fourth releasable securement means secured to the first end of the second half female portion, the third and fourth releasable securement means positioned to engage and releasably secure the first and second half female portions together when the first and second half female portions are pivoted about the female hinge into a closed position about the first end of the closed male portion;

i) at least one of the male end aperture and the female end aperture includes an aperture extension to limit ravel of the electrical plug and socket within the releasable extension cord connector apparatus;

j) the first and second male coupling connectors forming a rounded end when releasably secured together, and the first and second female coupling connectors forming a rounded end when releasably secured together about the first end of the male coupling connectors, the rounded ends resisting entanglement when the releasable extension cord connector apparatus is pulled around corners and past obstacles.

16. The releasable extension cord connector apparatus of claim 15, wherein the rounded end of the closed first and second male coupling connectors are shaped with a bullet nosed end, and the rounded end of the closed first and second female coupling connectors are shaped with an opposing bullet nosed end when assembled together to form the releasable extension cord connector apparatus.

* * * * *